US008512076B2

(12) United States Patent
Zhang et al.

(10) Patent No.: US 8,512,076 B2
(45) Date of Patent: Aug. 20, 2013

(54) INPUT/OUTPUT CONNECTOR ASSEMBLY

(75) Inventors: Xiang Zhang, Wuhan (CN); Chao Geng, Wuhan (CN); Li-Fu Xu, Wuhan (CN)

(73) Assignees: Hong Fu Jin Precision Industry (WuHan) Co., Ltd., Wuhan (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/369,389

(22) Filed: Feb. 9, 2012

(65) Prior Publication Data

US 2013/0005185 A1 Jan. 3, 2013

(51) Int. Cl.
*H01R 13/648* (2006.01)

(52) U.S. Cl.
USPC ..... 439/607.23

(58) Field of Classification Search
USPC ..... 439/607.23, 607.25, 607.58, 551, 439/564, 939, 540.1, 625, 620.22; 361/679.41
See application file for complete search history.

(56) References Cited

U.S. PATENT DOCUMENTS

| | | | | |
|---|---|---|---|---|
| 4,643,509 | A * | 2/1987 | Hollyday et al. | 439/607.28 |
| 5,152,699 | A * | 10/1992 | Pfeifer | 439/620.16 |
| 5,975,958 | A * | 11/1999 | Weidler | 439/620.22 |
| 6,033,263 | A * | 3/2000 | Weidler et al. | 439/620.1 |
| 6,398,588 | B1 * | 6/2002 | Bickford | 439/607.58 |
| 6,755,686 | B2 * | 6/2004 | Scherer et al. | 439/564 |
| 7,473,131 | B2 * | 1/2009 | Dunwoody et al. | 439/607.01 |
| 8,353,724 | B2 * | 1/2013 | Shi et al. | 439/625 |
| 2008/0214045 | A1 * | 9/2008 | Tu et al. | 439/540.1 |
| 2009/0269977 | A1 * | 10/2009 | Chen et al. | 439/540.1 |

* cited by examiner

*Primary Examiner* — Alexander Gilman
(74) *Attorney, Agent, or Firm* — Altis Law Group, Inc.

(57) ABSTRACT

An input/output (I/O) connector assembly includes an I/O connector module and a holder for accommodating the I/O connector module. The I/O connector module includes a plurality of I/O connectors and an Electro Magnetic Interference (EMI) shielding member located below each of the plurality of I/O connectors. The EMI shielding member includes a flat piece, a first resilient piece extending slantingly upwards from the flat piece, and a second resilient piece extending slantingly downward from the flat piece. A plurality of receiving holes is defined in the holder. The plurality of I/O connecters extends through and protrudes out from the plurality of receiving holes. The first resilient piece abuts a corresponding one of the plurality of I/O connectors. The second resilient piece abuts the holder.

18 Claims, 7 Drawing Sheets

INPUT/OUTPUT CONNECTOR ASSEMBLY

BACKGROUND

1. Technical Field

The present disclosure relates to an input/output (I/O) connector assembly for a computer.

2. Description of Related Art

Computers may include a chassis and an I/O connector assembly attached to the chassis. The I/O connector assembly may include a holder attached to the chassis and an I/O connector module accommodated in the holder. The I/O connector module may include Universal Serial Bus (USB) connectors, audio connectors, and FireWire connectors, etc. A plurality of receiving holes may be defined in the holder. The connectors extend through and protrude out from the plurality of receiving holes for facilitating user access. The I/O connector module may be secured to the holder by fasteners, which is inconvenient for mounting or detaching the I/O connector module. Furthermore, there may be no electromagnetic interference (EMI) protection for the I/O connector module.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation. In the figures of the accompanying drawings in which like references indicate similar elements. It should be noted that references to "an" or "one" embodiment in this disclosure are not necessarily to the same embodiment, and such references mean at least one.

Figure 1:
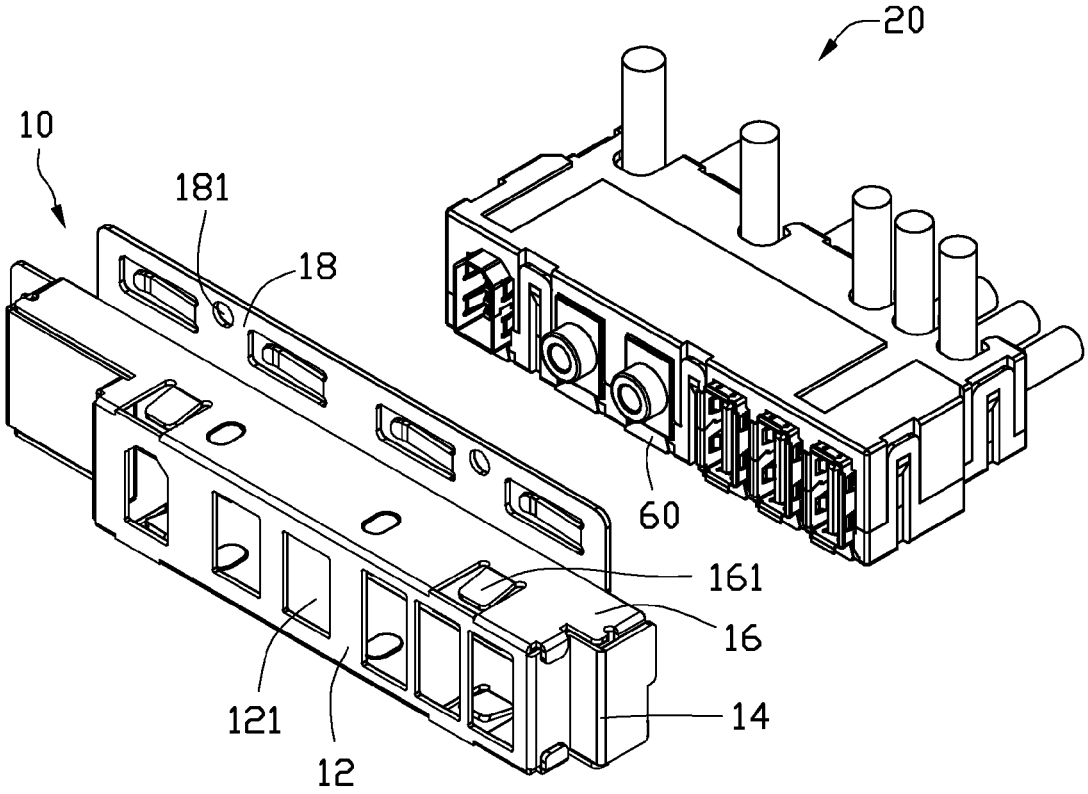
FIG. 1 is an exploded view of an I/O connector assembly according to an embodiment.

Referring to FIG. 1, an embodiment of an I/O connector assembly includes a holder 10 and an I/O connector module 20. The holder 10 includes a front plate 12, a pair of sidewalls 14 extending from opposite side edges of the front plate 12, a top plate 16 extending substantially perpendicularly from a top edge of the front plate 12, and a securing flange 18 extending substantially perpendicularly from the top plate 16. A plurality of receiving holes 121 is defined in the front plate 12. A pair of resisting pieces 161 extends slantingly downward from the top plate 16 relative to the top plate 16. A pair of securing holes 181 is defined in the securing flange 18 for securing the holder 10 to a computer chassis (not shown).

Figure 2:
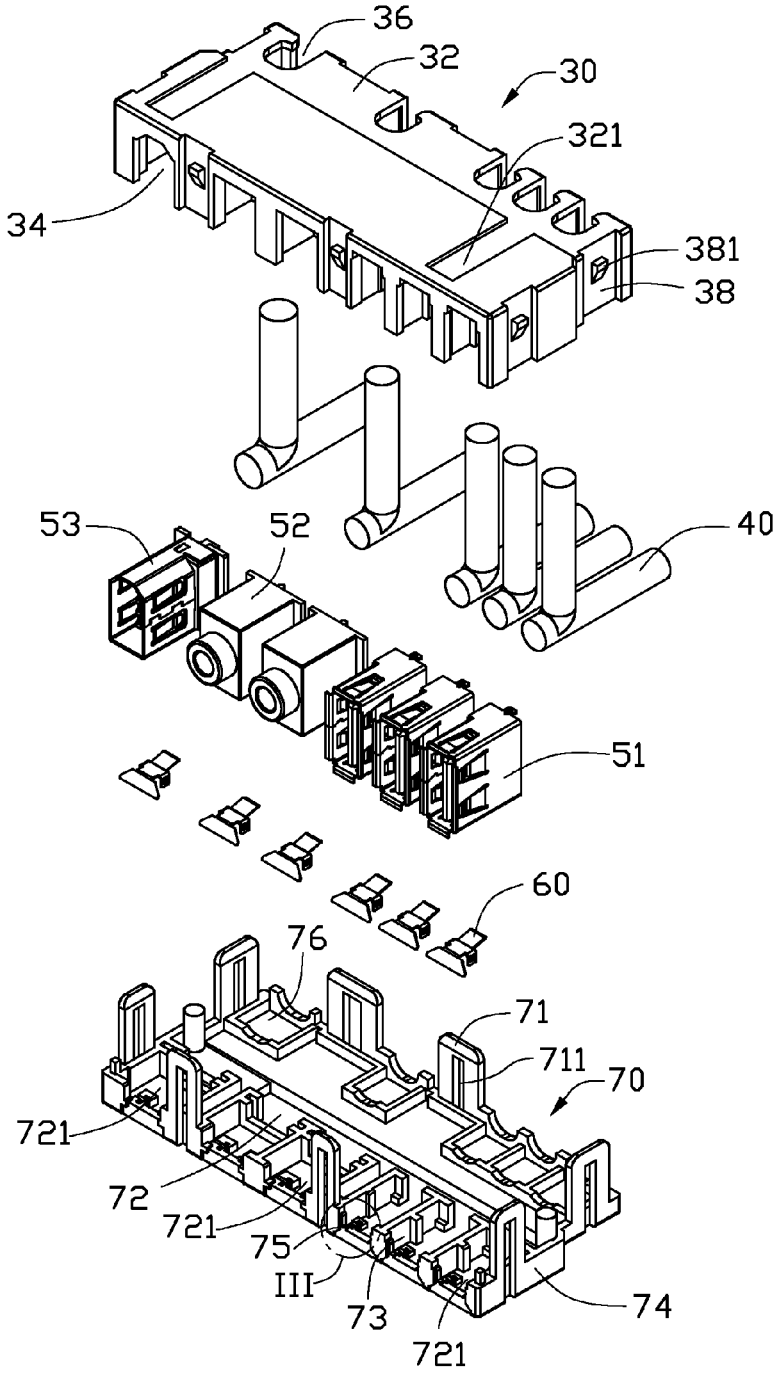
FIG. 2 is an exploded view of an I/O connector module of the I/O connector assembly of FIG. 1.
Figure 3:
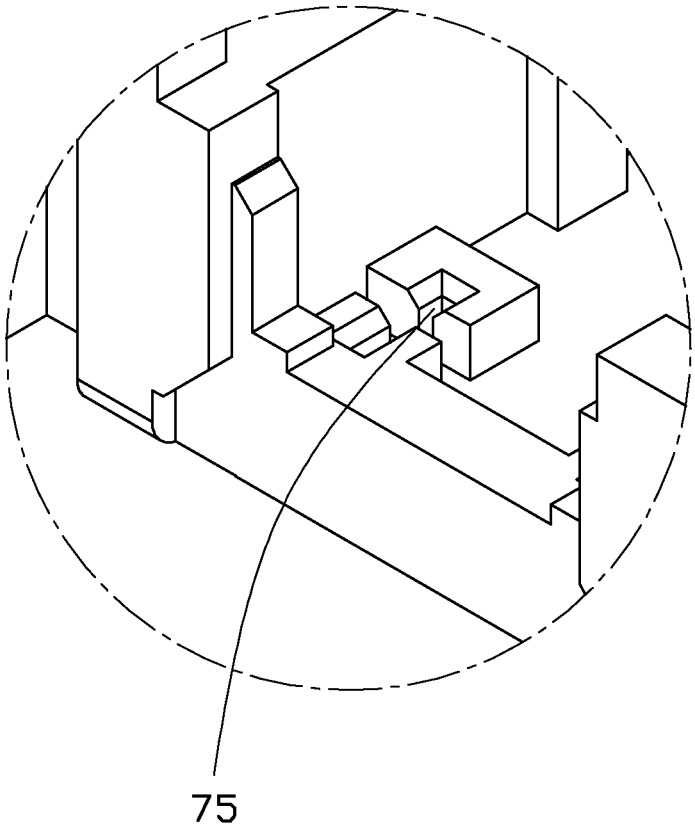
FIG. 3 is an enlarged view of a circled portion III of FIG. 2.
Figure 4:
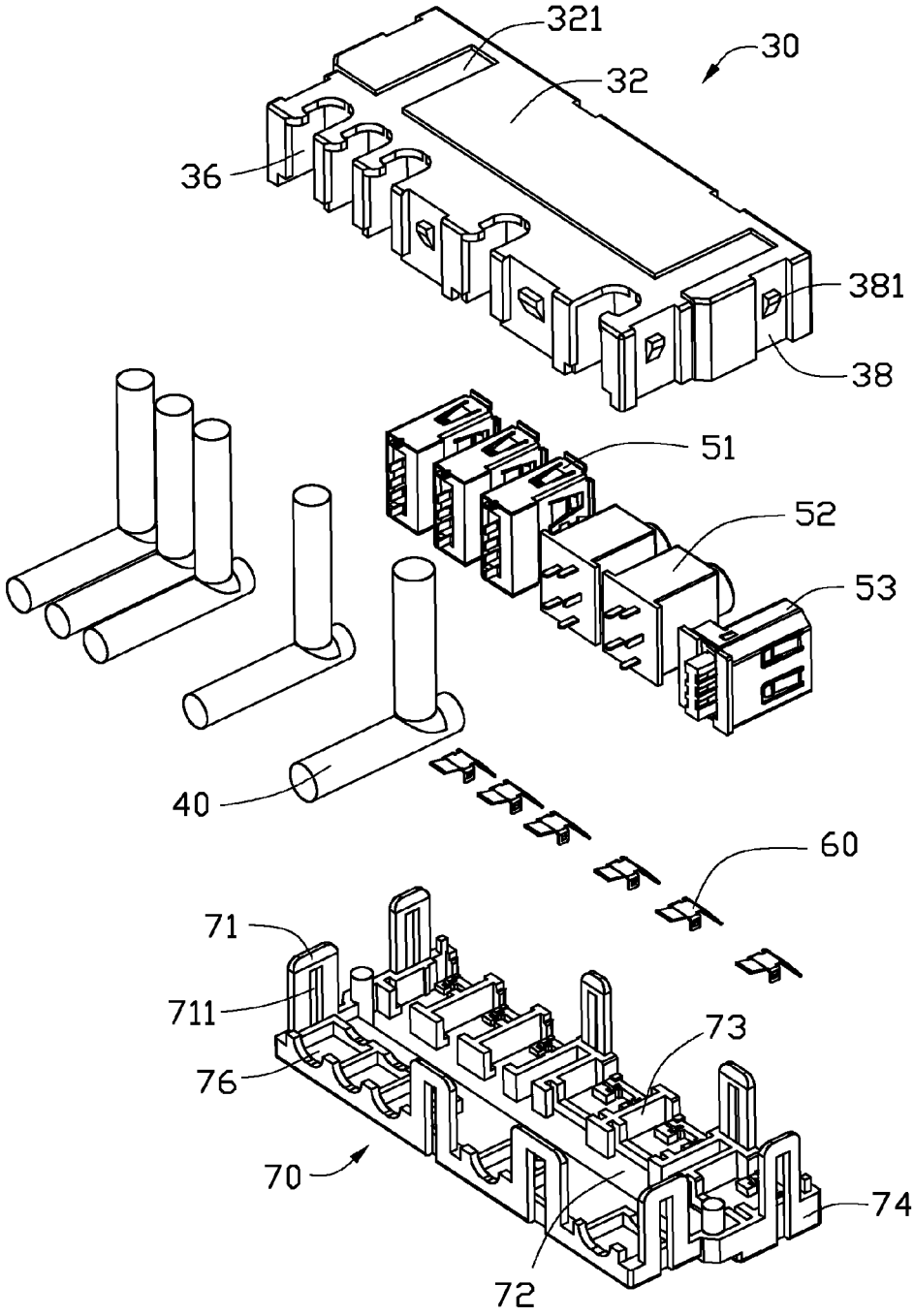
FIG. 4 is similar to FIG. 2, but viewed from another aspect.

Referring to FIGS. 2 to 4, the I/O connector module 20 includes a top cover 30, a plurality of cables 40, a plurality of I/O connectors, a plurality of EMI shielding members 60, and a base cover 70. The plurality of I/O connectors includes three USB connectors 51, two audio connectors 52, and a FireWire connector 53. The top cover 30 includes a top wall 32 and a pair of sidewalls 38 extending substantially perpendicularly from opposite sides of the top wall 32. A plurality of receiving cavities 34 are defined in the top cover 30 and located below the top wall 32. A plurality of cable holding slots 36 are defined in the top cover 30 and extends through the top wall 32. The plurality of receiving cavities 34 are located at a front side of the top cover 30. The plurality of cable holding slots 36 are located at a rear side of the top cover 30. A pair of grooves 321 is defined in the top wall 32 corresponding to the pair of resisting pieces 161. A first wedge-shaped protrusion 381 protrudes from each of the sidewalls 38.

The base cover 70 includes a base plate 72 and a plurality of clamping pieces 71 substantially perpendicularly extending upward from the periphery of the base plate 72. An elongate slot 711 is defined in each of the plurality of clamping pieces 71. The base cover 70 further comprises a plurality of cable holding portions 76 corresponding to the plurality of cable holding slots 36. Each of the plurality of cable holding slots 36 and a corresponding one of the plurality of cable holding portions 76 are capable of jointly holding each of the plurality of cables 40. A pair of side flanges 74 substantially perpendicularly extends upward from a pair of short side edges of the base plate 72. A plurality pairs of separating blocks 73 protrude upward from the base plate 72 and is located between the pair of side flanges 74. An accommodating space 721 is located between each pair of separating blocks 73 for accommodating each of the plurality of I/O connectors. An engaging notch 75 is located in the accommodating space 721 (see FIG. 3).

Figure 5:
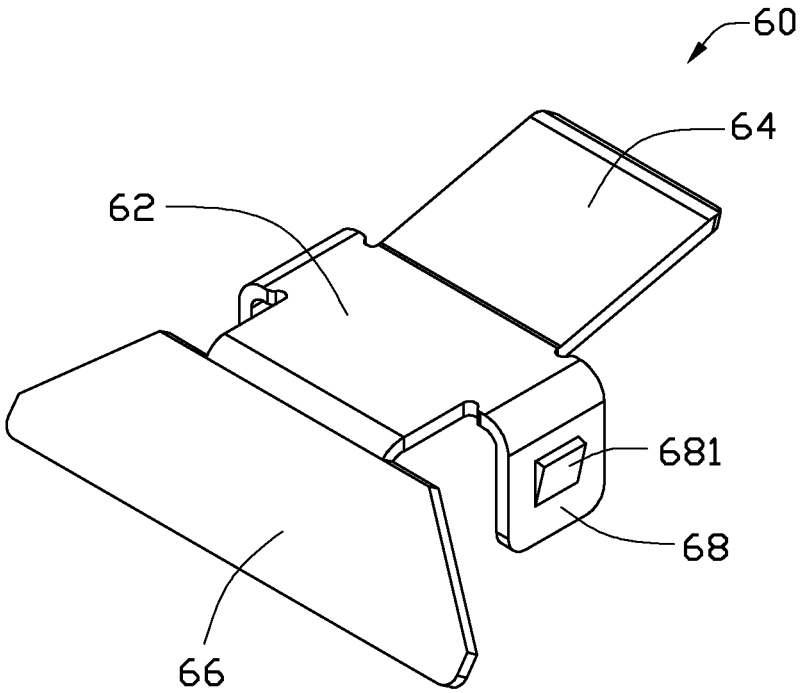
FIG. 5 is an EMI shielding member of the I/O connector module of FIG. 2.

Referring to FIG. 5, each of the plurality of EMI shielding members 60 includes a flat piece 62, a first resilient piece 64 extending slantingly upwards from a rear flange of the flat piece 62, a second resilient piece 66 extending slantingly downward from a front edge of the flat piece 62, and a pair of securing pieces 68 substantially perpendicularly extending downward from opposite side edges of the flat piece 62. A second wedge-shaped protrusion 681 protrudes from each of the pair of securing pieces 68.

Figure 6:
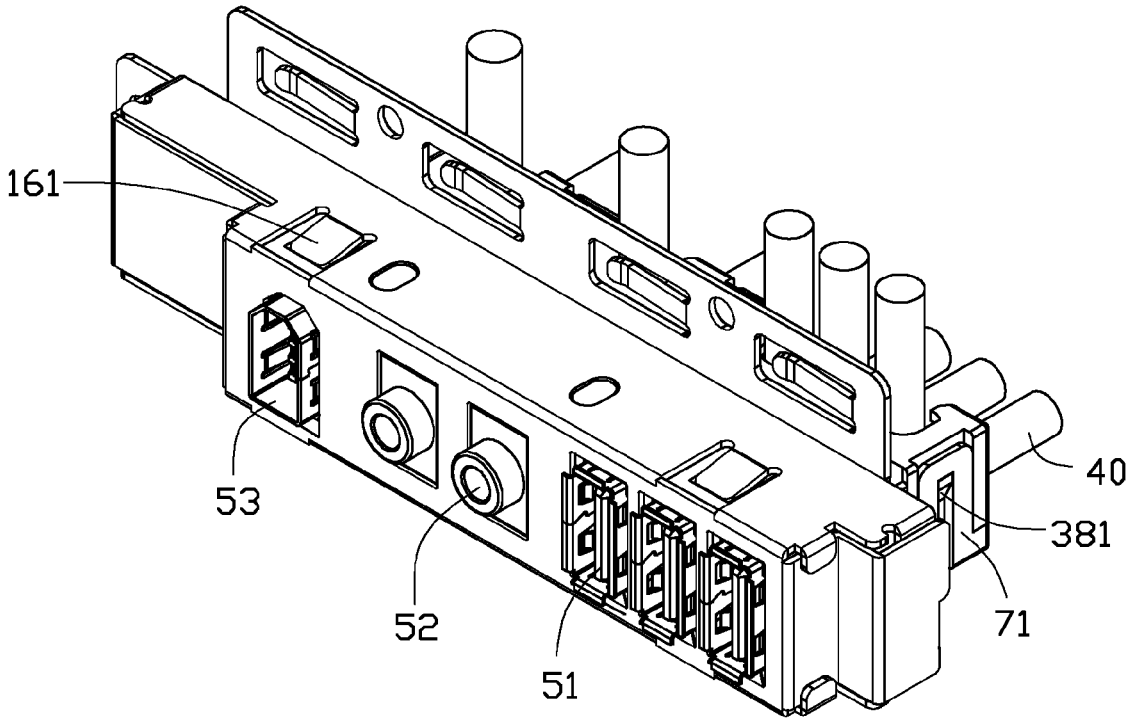
FIG. 6 is an assembly view of the I/O connector assembly of FIG. 1.
Figure 7:
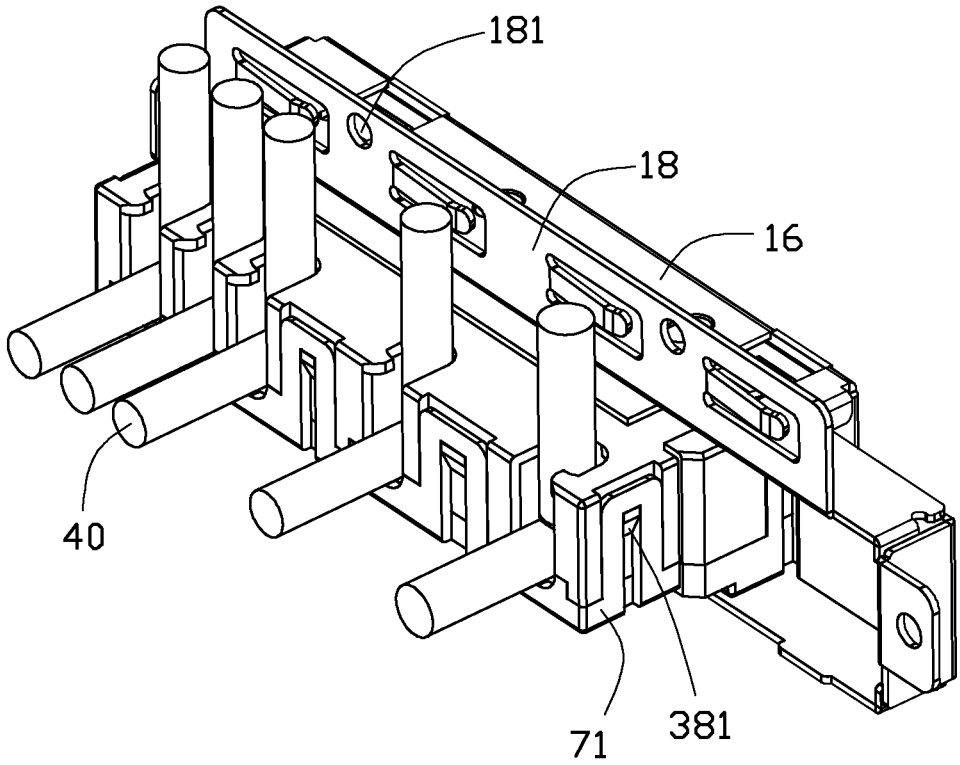
FIG. 7 is similar to FIG. 6, but viewed from another aspect.

Referring to FIGS. 6 and 7, in assembly, the second wedge-shaped protrusion 681 is engaged with the engaging notch 75. Each of the plurality of EMI shielding members 60 is secured in the accommodating space 721. Each of the plurality of I/O connectors is moved into a corresponding accommodating space and abuts the first resilient piece 64. The second resilient piece 66 protrudes out from the base cover 70. The plurality of I/O connectors is aligned with the plurality of receiving cavities 34. The top cover 30 moves down towards the base cover 70. The first wedge-shaped protrusion 381 deforms a corresponding one of the plurality of clamping pieces 71 until the first wedge-shaped protrusion 381 engages with the elongate slot 711. The top cover 30 is secured to the base cover 70. The plurality of I/O connectors is accommodated in the plurality of receiving cavities 34 and located between the top cover 30 and the base cover 70. The plurality of cables 40 is received in the plurality of cable holding slots 36. The plurality of I/O connectors is aligned with the plurality of receiving holes 121. The holder 10 moves towards the I/O connector module 20 until the pair of resisting pieces 161 engages with the pair of grooves 321. The I/O connector module 20 is secured to the holder 10. The plurality of I/O connectors extends through and protrudes out from the plurality of receiving holes 121. The second resilient piece 66 abuts an inner surface of the holder 10.

In one embodiment, each of the plurality of EMI shielding members 60 and the holder 10 are made from electrically conductive metal. The first resilient piece 64 abuts the bottom of a corresponding one of the plurality of I/O connectors. The second resilient piece 66 abuts the holder 10. Each of the plurality of EMI shielding members 60 can minimize or ground EMI generated by the I/O connector module 20.

While the present disclosure has been illustrated by the description in this embodiment, and while the embodiment has been described in considerable detail, it is not intended to restrict or in any way limit the scope of the appended claims to such details. Additional advantages and modifications within the spirit and scope of the present disclosure will readily appear to those skilled in the art. Therefore, the present disclosure is not limited to the specific details and illustrative examples shown and described.

What is claimed is:

1. An input/output (I/O) connector assembly comprising:

an I/O connector module comprising a top cover, a base cover parallel with the top cover, a plurality of I/O connectors, and an Electro Magnetic Interference (EMI) shielding member located below each of the plurality of I/O connectors, the EMI shielding member comprising a flat piece, a first resilient piece extending slantingly upwards from a first edge of the flat piece, and a second resilient piece extending slantingly downward from a second edge of the flat piece, the first edge and the second edge located at a first opposite sides of the flat piece; and a holder configure to accommodate the I/O connector module, a plurality of receiving holes being defined in the holder, the plurality of I/O connecters extending through and protruding out from the plurality of receiving holes;

wherein the first resilient piece abuts a corresponding one of the plurality of I/O connectors, and the second resilient piece abuts the holder; the top cover defines a plurality of cable holding slots extending in a direction perpendicular to the top cover; the base cover comprises a plurality of cable holding portions corresponding to the plurality of cable holding slots, and each of the plurality of cable holding slots and a corresponding one of the plurality of cable holding portions are capable of jointly holding a cable.

2. The I/O connector assembly of claim 1, wherein each of the plurality of I/O connectors is located between the top cover and the base cover and protrudes out from the top cover.

3. The I/O connector assembly of claim 2, wherein a plurality of receiving cavities is defined in the top cover, each of the plurality of I/O connectors is accommodated in each of the plurality of receiving cavities and protrudes out from each of the plurality of receiving cavities.

4. The I/O connector assembly of claim 3, wherein the plurality of cable holding slots are located at a rear side of the top cover, the plurality of receiving cavities are located at a front side opposite to the rear side of the top cover.

5. The I/O connector assembly of claim 4, wherein the top cover comprises a top wall located above the plurality of receiving cavities, at least one groove is defined in the top wall, the holder comprises at least one resilient resisting piece engaging with the at least one groove for securing the holder to the I/O connector module.

6. The I/O connector assembly of claim 5, wherein the top cover further comprises a pair of sidewalls extending from opposite side edges of the top wall, a first wedge-shaped protrusion protrudes from each of the pair of sidewalls, the base cover comprises a pair of clamping pieces, an elongate slot is defined in each of the pair of clamping pieces and engaged with the first wedge-shaped protrusion.

7. The I/O connector assembly of claim 2, wherein the base cover comprises a base plate, a pair of side flanges extending upward from opposite sides of the base plate, and a plurality pairs of separating blocks protruding upward from the base plate and located between the pair of side flanges, an accommodating space is defined between each pair of the plurality pairs of separating blocks for accommodating the EMI shielding member.

8. The I/O connector assembly of claim 7, wherein the base cover comprises an engaging notch located in the accommodating space, the EMI shielding member further comprises a pair of securing pieces extending from a second opposite sides of the flat piece, a second wedge-shaped protrusion protrudes from each of the pair of securing pieces; the second wedge-shaped protrusion is engaged with the engaging notch for securing the EMI shielding member to the base cover.

9. The I/O connector assembly of claim 1, wherein the holder and the EMI shielding member are made from electrically conductive metal.

10. An input/output (I/O) connector assembly comprising:

an I/O connector module comprising a top cover, a base cover parallel with the top cover, at least one I/O connector, and an Electro Magnetic Interference (EMI) shielding member, the EMI shielding member comprising a flat piece, a first resilient piece extending from the flat piece and abutting a bottom of the at least one connector, and a second resilient piece extending from the flat piece, the first resilient piece and the second edge located at a first opposite sides of the flat piece; and a holder configured to accommodate the I/O connector module, at least one receiving hole being defined in the holder, the at least one I/O connecter extending through and protruding out from the at least one receiving hole, the second resilient piece abutting an inner surface of the holder;

wherein the top cover comprises a top wall and defines a plurality of cable holding slots extending in a direction perpendicular to the top wall; the base cover comprises a plurality of cable holding portions corresponding to the plurality of cable holding slots, and each of the plurality of cable holding slots and a corresponding one of the plurality of cable holding portions are capable of jointly holding a cable.

11. The I/O connector assembly of claim 10, wherein the at least one I/O connector is located between the top cover and the base cover and protrudes out from the top cover.

12. The I/O connector assembly of claim 11, wherein at least one receiving cavity is defined in the top cover, the at least one I/O connector is accommodated in the at least one receiving cavity and protrudes out from the at least one receiving cavity.

13. The I/O connector assembly of claim 12, wherein the plurality of cable holding slots are located at a rear side of the top cover, the at least one receiving cavity is located at a front side opposite to the rear side of the top cover.

14. The I/O connector assembly of claim 13, wherein the top cover comprises a top wall located above the at least one receiving cavity, at least one groove is defined in the top wall, the holder comprises at least one resilient resisting piece engaging with the at least one groove for securing the holder to the I/O connector module.

15. The I/O connector assembly of claim 14, wherein the top cover further comprises a pair of sidewalls extending from opposite side edges of the top wall, a first wedge-shaped protrusion protrudes from each of the pair of sidewalls, the base cover comprises a pair of clamping pieces, an elongate slot is defined in each of the pair of clamping pieces and engaged with the first wedge-shaped protrusion.

16. The I/O connector assembly of claim 11, wherein the base cover comprises a base plate, a pair of side flanges extending from opposite sides of the base plate, and a plurality pairs of separating blocks protruding from the base plate and located between the pair of side flanges, an accommodating space is defined between each pair of the plurality pairs of separating blocks for accommodating the EMI shielding member.

17. The I/O connector assembly of claim 16, wherein the base cover comprises an engaging notch located in the accommodating space, the EMI shielding member further comprises a pair of securing pieces extending from opposite side edges of the flat piece, a second wedge-shaped protrusion protrudes from each pair of securing pieces; the second wedge-shaped protrusion is engaged with the engaging notch for securing the EMI shielding member to the base cover.

18. The I/O connector assembly of claim 10, wherein the first resilient piece extends slantingly upwards from the flat piece, the second resilient piece extends slantingly downward from the flat piece.

* * * * *